US006135798A

United States Patent [19]

Saruta et al.

[11] Patent Number: 6,135,798

[45] Date of Patent: Oct. 24, 2000

[54] AUTOMOTIVE BATTERY PLUG

[75] Inventors: Hiroshi Saruta; Hiroshi Yokozawa, both of Tokyo, Japan

[73] Assignees: Mitsubishi Corporation; SMK Corporation, both of Tokyo, Japan

[21] Appl. No.: 09/202,148

[22] PCT Filed: Aug. 22, 1997

[86] PCT No.: PCT/JP97/02920

§ 371 Date: Aug. 4, 1999

§ 102(e) Date: Aug. 4, 1999

[87] PCT Pub. No.: WO98/45903

PCT Pub. Date: Oct. 15, 1998

[30] Foreign Application Priority Data

Apr. 10, 1997 [JP] Japan ..... 9-106845

[51] Int. Cl.[7] ..... H01R 13/62

[52] U.S. Cl. ..... 439/259

[58] Field of Search ..... 439/259, 668, 439/669, 621, 622, 600, 218

[56] References Cited

U.S. PATENT DOCUMENTS 5,261,838 11/1993 Fujie ..... 439/668
5,263,879 11/1993 Sasa ..... 439/668
5,897,397 4/1999 Yokozawa ..... 439/668
5,924,895 6/1999 Moji ..... 439/668

*Primary Examiner*—Gary F. Paumen
*Assistant Examiner*—Chi Nguyen
*Attorney, Agent, or Firm*—Armstrong, Westerman, Hattori, McLeland & Naughton

[57] ABSTRACT

An automotive battery plug (1), once fitted in a cigar lighter socket (111), is retained therein with proper retentive force. When it is pulled out of the socket, the retentive force decreases, allowing ease in the removal of the plug (1). A slider (25, 31) slidable in a plug housing (2) has on its either side surface a support portion (25*a*) and an inclined portion (25*b*) forming a slope (26) contiguous to the support portion (25*a*). When a return end portion (17*b*) of each leaf-spring contact piece (17) abuts with the support portion (25*a*) of the slider (25), a contact portion (17*a*) of the contact piece (17) greatly protrudes from the periphery of the plug housing (2) through an opening (19), permitting the battery plug (1) to be fitted and held in the cigar lighter socket (111) with suitable retentive force. When the battery plug (1) is pulled out of the cigar lighter socket (111), an operating knob (24) in a grip (22) is moved rearward, by which the slider (25, 31) also slides, causing the return end portion (17*b*) to slide down the slope (26) and go into the plug housing (2). In consequence, the contact portion (17*a*) of the leaf-spring contact piece (17) retracts to its inner position of protusion nearer to the opening (19), decreasing the plug retentive force and allowing ease in puking out the battery plug (1) from the cigar lighter socket (111).

3 Claims, 5 Drawing Sheets

AUTOMOTIVE BATTERY PLUG

FIELD OF THE INVENTION

The present invention relates to an automotive battery plug that is fitted into an automotive cigar lighter socket and electrically connected thereto to supply power to portable equipment carried in a motor vehicle.

DESCRIPTION OF THE PRIOR ART

In recent years, a lot of in-car electrical equipment, such as car navigation equipment and communication equipment, have been commercially manufactured, and at the same time, car battery plugs have come into wide use to derive power from vehicle-mounted cigar lighter sockets for supply to those equipment.

FIG. 10 is a diagrammatic representation of the construction of a conventional automotive battery plug indicated generally by 100, which has a cylindrical plug housing 101 and an insulating cap 102 threadably attached to the forward end portion of the plug housing 101. The insulating cap 102 has a through hole 102*a*, through which a head terminal 103 is inserted in a manner to be movable back and forth. As shown, a shoulder 103*a* of the head terminal 103 abuts against a stepped portion formed in the through hole 102 to limit outward movement of the head terminal 103. The head terminal 103 has in its rear end a circularly-sectioned recess 103*b* opening rearward, which receives a tip-end terminal 106*a* of a fuse tube 106, establishing electric connections between the terminal 106*a* and the head terminal 103.

Disposed in the plug housing 101 centrally thereof is a fixed terminal 105, which is fixed to the plug housing 101 through a stationary part 104 formed integrally therewith. The fixed terminal 105 has its leg 105*a* extended rearward and soldered to a power-supply lead wire of a power cord not shown. The fixed terminal 105 has a pair of opposed arms 105*b*, which have their opposing surfaces concavely curved and receive or hold therebetween a conductive coiled spring 107. Between the head terminal 103 and the fixed terminal 105 there are placed in tandem the fuse tube 106 and the conductive coiled spring 107 so that the head terminal 103 is urged by the compressed conductive spring 107 in a direction in which to project out of the forward end of the plug housing 101.

Thus, the head terminal 103 is electrically connected via the fuse tube 106 and the conductive coiled spring 107 to the fixed terminal 105 which is electrically connected to the power-side lead wire of the power cord. The fuse tube 106 forms an overcurrent protection circuit.

Along the opposite sides of the plug housing 101 there are mounted a pair of leaf-spring contact pieces 108, each having its free end portion arcuately bowed or bent inward in a U-letter shape. One of the leaf-spring coils 108 has its leg 108*a* extended backward and soldered to a grounding lead wire of the power cord, though not shown.

Each leaf-spring contact piece 108 has its leg 108*a* fixedly fitted in a groove 101*a* made in the plug housing 101 so that its circularly arcuate contact portion 108*b* protrudes from the periphery of the plug housing 101 through an opening 109 made in one side thereof.

An inwardly bent return end portion 108*c* of each leaf-spring contact piece 108 abuts against the outer wall surface 101*b* of the plug housing 101 which is aligned with the opening 109.

The plug housing 101 comprises a pair of axially-divided half shells, which are joined together by threading a screw (not shown) into a tapped hole 110 after putting the fixed terminal 105, the leaf-spring contact pieces 108 and other parts in one of the half shells and then covering it with the other half shell.

When the automotive battery plug 100 of the above construction is inserted into a cigar lighter socket 111, the contact portions 108*b* of the leaf-spring contact pieces 108 make resilient contact with the inner wall of a cylindrical grounding terminal 111*a*, and when the battery body 100 is further pushed into the socket 111, the head terminal 103 is pressed into resilient contact with a power terminal 111*b* partly exposed on the inner end face of the socket 111. In consequence, the grounding terminal 111*a* and power terminal 111*b* of the cigar lighter socket 111 are electrically connected via the battery plug 100 to the grounding and power-supply lead wires of the power cord, respectively.

With the above conventional automotive battery plug 100, the leaf-spring contact pieces 108 have their base end portions fixedly held in the grooves 101*a* of the plug housing 101 and their arcuately bowed free end portions held in abutment with the outer wall surface 101*b* of the plug housing 101, with the contact portions 108*b* protruding far from the plug housing 101 through the opening 109.

Accordingly, the contact portions 108*b* resiliently contact the cylindrical grounding terminal 111*a* of the cigar lighter socket 111 with a sufficient contact pressure, and the automotive battery plug 100 will not readily come out the cigar lighter socket 111.

However, as the contact portions 108*b* of leaf-spring contact pieces 108 contact the cylindrical grounding terminal 111*a* with relatively great resiliency, however, the battery plug 100 is hard to be pulled out from the cigar lighter socket 111 without a considerable amount of force.

The force for pulling out the battery plug 100 from the cigar lighter socket 111 could be reduced by changing the shapes of the leaf-spring contact pieces 108 or the positions where to mount them in the plug housing 101. This, however, gives rise to the problem of insufficient contact pressure between the contact pieces 108 and the cylindrical grounding terminal 111*a* and hence insecure retention of the plug 100 in the socket 111. Accordingly, it is impossible with the prior art to meet contradictory requirements of a firm retention of the automotive battery plug 100 in the cigar lighter socket 111 and easy removal of the former from the latter.

SUMMARY OF THE INVENTION

It is therefore an object of the present invention to provide an automotive battery plug that can be held in the cigar lighter socket with a sufficient contact pressure thereto and with sufficient retentive force and can easily be pulled out therefrom.

According to an aspect of the present invention, there is provided an automotive battery plug which comprises: a cylindrical plug housing for insertion into a cigar lighter socket; a pair of leaf-spring contact pieces each having its base portion fixed in the cylindrical plug housing and its free end portion bent into a U-letter shape so that an outside contact portion extending from the base portion protrudes from the periphery of the plug housing through an opening thereof and an inside return end portion lies in the plug housing; a slider disposed in the plug housing in a manner to be slidable lengthwise thereof, either side surface of the slider resiliently contacting the return end portion of the leaf-spring contact piece; support portion formed in either side surface of the slider for resilient contact with the return end portion, the return end portion sliding into abutment with the support portion when the slider slides forward; an inclined portion formed in either side surface of the slider and contiguous to the support portion along the front edge thereof so that when the slider slides backward, the return end portion slides down a slope into the plug housing; and an operating knob exposed on a grip of the plug housing through an operating aperture made therein and operatively associated with the slider.

When the automotive battery plug is pulled out of the cigar lighter socket, the return end portion of each leaf-spring contact piece is retracted into the plug housing by the operating knob moved backward.

With this structure, when the automotive battery plug is inserted into the cigar lighter socket, the operating knob exposed on the grip of the plug housing is moved forward by the user's finger during the manual operation for fitting the plug into the socket. Operatively associated with the forward movement of the operating knob, the slider slides forward in the plug housing, causing the return end portions of the leaf-spring contact pieces to abut against the support portions on the both side surfaces of the slider.

When the return end portions of the leaf-spring contact pieces abut against the support portions of the slider, their contact pieces greatly protrude to their outermost positions through the openings, and when the battery plug is fitted in the cigar lighter socket, they resiliently contact the interior surface of a cylindrical grounding terminal of the cigar lighter socket with a sufficient contact pressure by reaction forces from the support portions.

In the case of pulling out the automotive battery plug from the cigar lighter socket, the operating knob is moved rearward by the user's finger during the manual operation for removing the plug from the socket.

When the slider moves rearward with the backward movement of the operating knob, the return end portions of the leaf-spring contact pieces slide down the slopes of the inclined portions on the both side surfaces of the slider and go into the plug housing. As the result of this, the contact portions of the leaf-spring contact pieces protruding through the openings retract to their inner positions and the pressure of their contact with the cigar lighter socket decreases accordingly.

Thus, the leaf-spring contact pieces can be electrically connected to the grounding terminal of the cigar lighter socket with a sufficient contact pressure thereto, and in this state, the battery plug will not readily come off the cigar lighter socket. On the other hand, the battery plug can be pulled out of the socket with ease without any particularly large force.

According to another aspect of the present invention, a return spring is disposed in the plug housing to urge the slider toward the forward portion of the plug housing so that the return end portions of the leaf-spring contact pieces in its normal state abut against the support portions on both side surfaces of the slider.

With this structure, even while the operating knob is left unoperated, the slider is urged forward by the return spring and the return end portions of the leaf-spring contact pieces abut against the support portions on both side surfaces of the slider. Accordingly, even when the operating knob is not actuated in the case of inserting the battery plug into the cigar lighter socket, the contact portions of the leaf-spring contact pieces fully protrude through the openings and resiliently contact the cigar lighter socket with a sufficient contact pressure.

In the case of pulling out the battery plug from the cigar lighter socket, the operating knob is moved rearward against the spring action of the return spring, causing the returned portions of the leaf-spring contact pieces to slide on the slopes of the inclined portions. As a result, the return end portions of the contact pieces go into the plug housing, allowing removal of the battery plug from the socket with a small amount of force.

Since the contact portions of the contact pieces are adjusted by the return spring automatically to protrude to their outermost positions through the openings, they can be electrically connected to the grounding terminal of the cigar lighter socket with a sufficient contact pressure without involving any particular preadjustment.

According to still another aspect of the present invention, the support portion on either side surface of the slider has cut therein a positioning groove for engagement with the return end portion of the leaf-spring contact piece.

With this structure, when abutting against the support portion of the slider, the return end portion engages the positioning groove—this precludes the possibility of the slider being slid by an external force inadvertently applied thereto when the battery plug is fitted and held in the cigar lighter socket. Hence, there is no fear that the return end portions of the contact pieces are caused by unexpected external force to slide down the slopes, lowering the plug retentive force.

Other objects, features and advantages of the present invention will become more apparent from the following description taken in conjunction with the accompanying drawings, in which like reference numerals designate the same elements.

DESCRIPTION OF THE PREFERRED EMBODIMENTS

Figure 7:
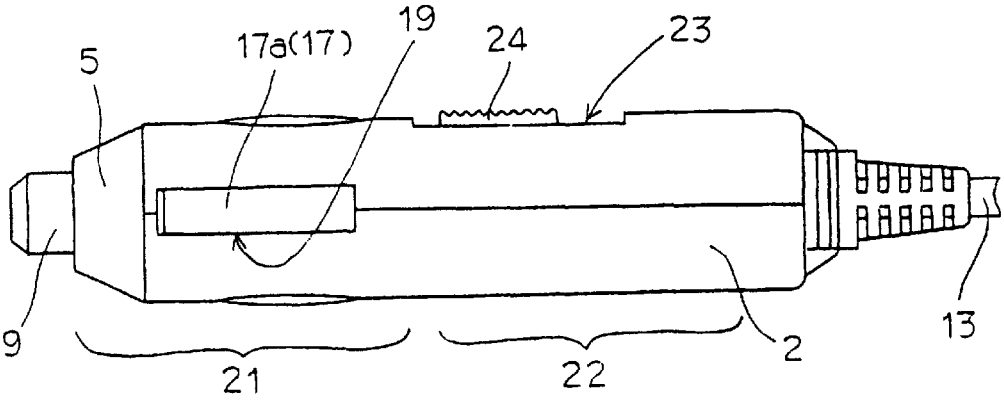
FIG. 7 is its side view.

A description will be given first, with reference to FIGS. 1 and 7, of an automotive battery plug according to an embodiment of the present invention, the battery plug being identified generally by reference numeral 1.

Figure 1:
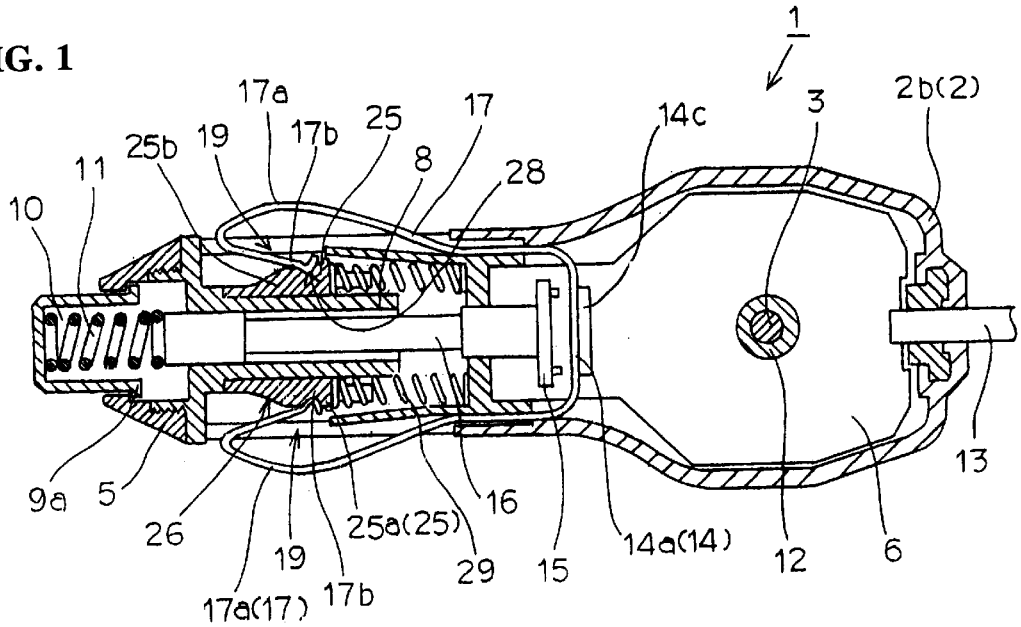
FIG. 1 is a horizontal sectional view showing an automotive battery plug according to a first embodiment of the present invention in its normal state prior to insertion into a cigar lighter socket.
Figure 2:
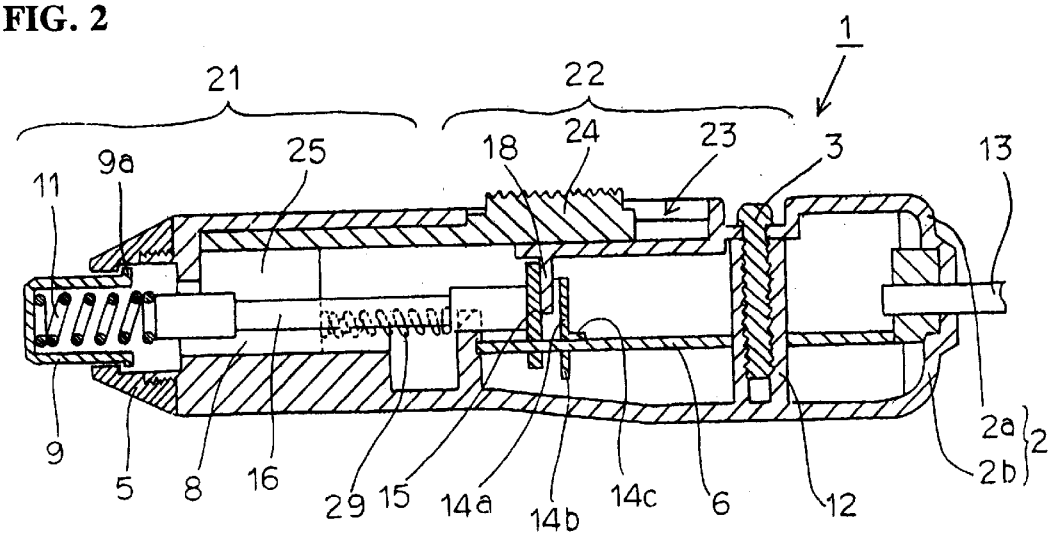
FIG. 2 is a longitudinal sectional view of the battery plug shown in FIG. 1.
Figure 6:
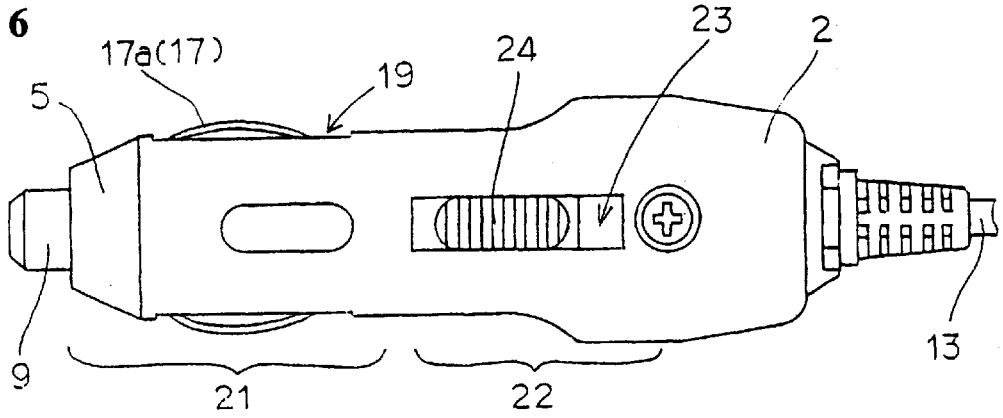
FIG. 6 is a plan view of the automotive battery plug.

FIGS. 1 and 2 are horizontal and longitudinal sectional views depicting the automotive battery plug 1 prior to insertion into the cigar lighter socket 111. The plug housing 2 is formed in one piece of an insulating synthetic resin material. As depicted in FIG. 2, the plug housing 2 comprises a pair of molded upper and lower half shells 2*a* and 2*b*. These half shells 2*a* and 2*b* are joined together by inserting a tap bolt 3 through the upper half shell 2*a* and then screwing it into a tapped hole made in the lower half shell 2*b* so that there is formed in the plug housing 1 a space where to place a fuse tube 16, a printed-circuit board 6 and so forth. As depicted in FIGS. 6 and 7, the front half portion of the plug housing 2 is an insert portion 21 that is inserted into a cigar lighter socket, and the rear half portion forms a grip 22. In the top of grip 22 of the plug housing 2 there is formed an elongated operating aperture 23, through which an operating knob 24 described later on slightly juts out.

Threadably attached to an opening in the tip of the insert portion 21 of the plug housing 2, as shown in FIGS. 1 to 4, is an insulating cap 5 molded of insulating synthetic resin. Since the insulating cap 5 is removable from the tip of the plug body 2, a fuse in the fuse tube 16, if burnt, could easily be replaced with a new one. The insulating cap 5 has a centrally-disposed cylindrical hole which has an annular stepped portion formed in its inside wall surface over the entire circumference thereof and in which a head terminal 9 is retractably received.

The head terminal 9 has a cylindrical but hollow body made of a conductive metal, and a flange 9*a* at its rear end abuts the above-mentioned annular stepped portion to prevent the head terminal 9 from coming out of the hole in the forward direction (to the left in FIG. 1). The interior of the head terminal 9 forms a circular cross-section cavity 10, wherein the front end portion of a conductive coiled spring 11 is received.

The head terminal 9, which supports the conductive coiled spring 11, is inserted through the cylindrical hole of the insulating cap 5 from behind to a position where the flange 9*a* of the head terminal 9 abuts the annular stepped portion on the interior surface of the hole and the head terminal 9 retractably extends out of the tip of the insulating cap 5.

In the grip 22 of the rear half portion of the plug housing 2, there is disposed the printed-circuit board 6. The printed-circuit board 6 has its perimeter contoured following the inside surface of the lower half shell 2*b*. The printed-circuit board 6 is positioned relative to the lower half shell 2*b* by a boss 12 planted thereon and inserted through a positioning hole bored through the printed-circuit board 6 centrally thereof.

On the printed-circuit board 6 there are mounted a grounding contact 14 and a fixed terminal 15, which are electrically connected to a grounding lead and a power-supply lead (not shown) of a power cord 13 respectively via patterns formed on the underside of the printed-circuit board 6.

The fixed terminal 15 is a conductive plate formed by stamping a sheet metal into a desired shape and subjecting it to simple bending. The fixed terminal 15 has a downward leg portion, which extends through the printed-circuit board 6 and is soldered to a power-supply pattern on the underside thereof As depicted in FIG. 2, the fuse tube 16 abuts against the fixed terminal 15 from the front, but a support piece 18 extending down from the upper half shell 2*a* of the plug housing 2 supports the fixed terminal 15 on the back thereof to prevent it from falling rearward.

The fuse tube 16 is received in a guide frame 8 of a U-shaped cross-section, formed as a unitary structure with the lower half shell 2*b*, and is disposed in the plug housing 2 lengthwise thereof. The conductive coiled spring 11 is held compressed by placing the fuse tube 16 between the fixed terminal 15 and the coiled spring 11.

Figure 5:
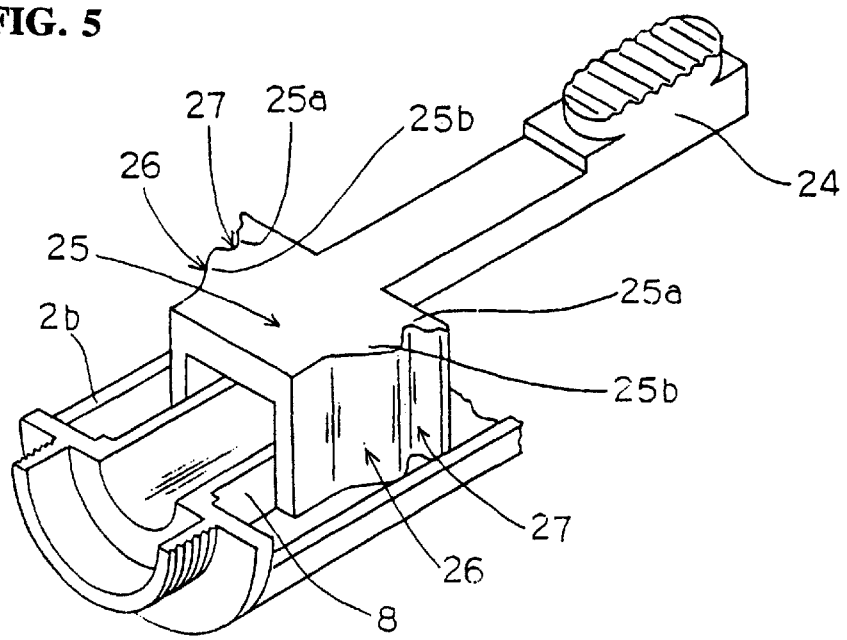
FIG. 5 is a perspective view showing a slider which is guided by a guide frame and its operating knob.

As depicted in FIG. 5, a slider 25 is mounted on the guide frame 8 in a manner to be slidable thereon in the lengthwise (front-to-back) direction of the plug housing 2. The slider 25 has on either side thereof a laterally projecting support portion 25*a* and an inclined portion 25*b* contiguous to the support portion 25*a* along the forward edge thereof and forming an inwardly slanting slope 26 in the forward direction. In the support portion 25*a* there is formed a vertically extending positioning groove 27, in which a return end portion 17*b* of a leaf-spring contact piece 17, which abuts against the support portion 25*a*, is received and hence positioned as described later on.

Molded integrally with the rear end portion of the slider 25 on the top thereof is the aforementioned operating knob 24, which is manually moved back and forth to shift the position of the slider 25. That is, the slider 25 is operatively associated with the operating knob 24. The operating knob 24 is inserted in the elongated operating aperture 23 of the upper half shell 2*a* from below and slightly juts out upwardly thereof for manual back-and-forth motion.

The slider 25 is urged forward by a compressed return spring 29 interposed between the rear end face of the slider 25 and the lower half shell 2*b* of the plug housing 2 as shown in FIGS. 1 and 2.

The grounding contact 14 is formed by bending a strip of conductive and resilient metal into substantially arch shape as shown in FIG. 1, in which the leaf-spring contact pieces 17 extend forward from opposite ends of its base portion 14*a*. The central portion of the lower side of the base portion 14*a* extends down through the printed-circuit board 6, and is soldered to a grounding pattern formed on the underside thereof. Thus, the grounding contact 14 is electrically connected via the grounding pattern to the grounding lead wire as referred to previously.

The remaining marginal portions of the lower side of the base portion 14*a*, except its downward extending central portion, are bent rearward at right angles to form a horizontal support piece 14*c*, supporting the base portion 14*a* upright on the printed-circuit board 6.

The pair of leaf-spring contact pieces 17 have their free end portions arcuately bowed or curved in substantially U-letter shape so that their circularly arcuate contact portions 17*a* protrude from the periphery of the plug housing 2 through openings 17*a* made in the opposite sides thereof.

The free end portions of the leaf-spring contact pieces 17 bent backward in the plug housing 2 form the return end portions 17*b*. The free ends of the return end portions 17*b* each extend into the plug housing 2 and resiliently contact one side surface of the slider 25. Since the slider 25 moves back and forth in the plug housing 2, the position of abutment of the free end of the return end portion 17*b* with the side surface of the slider 25 also shifts with its movement. As illustrated in FIG. 1, when the battery plug 1 is not fitted in the cigar lighter socket 111, the slider 25 is held at a position nearest to the front end of the guide frame 8 under the action of the return spring 29. In this instance, the return end portion 17*b* of each leaf-spring contact piece 17 abuts against the slider 25 at the support portion 25*a* and engages the positioning groove 27 cut in the support portion 25*a*.

Next, a description will be given of how the car battery plug 1 of the above construction will be fitted into and connected to the cigar lighter socket 111.

When the battery plug 1 is not fitted in the cigar lighter socket 111, the slider 25 is urged forward by the return spring 29 along the guide frame 8 and held at its foremost position, and consequently, the return end portion 17*b* of each leaf-spring contact piece 17 is in engagement with the positioning groove 27 cut in the support portion 25*a* of the slider 25. Since the support portion 25*a* is further to the outside than the slider body, the contact portions 17*a* of the leaf-spring contact pieces 17 greatly protrude through the openings 19.

Thus, in this case, when the battery plug 1 is fitted into the cigar lighter socket 111, the contact portions 17*a* of the leaf-spring contact pieces 17 resiliently contact a cylindrical grounding terminal 111*a* of the socket 111 with appropriate contact pressure, providing positive retention of the battery plug 1 in the socket 111.

The grounding terminal 111*a* is electrically connected to a grounding lead wire of the power cord 13 via the lead-spring contact pieces 17, the base portion 14*a* of the grounding contact 14 and the grounding pattern of the printed-circuit board 6, and when the battery plug 1 is further pushed into the socket 111, the head terminal 9 is pressed into resilient contact with a power-supply terminal 111*b* formed on the inner end face of the socket 111. In consequence, the power-supply terminal 111*b* is electrically connected to a power-supply lead wire of the power cord 13 via the head terminal 9, the conductive coiled spring 11, the fuse tube 16, the fixed terminal 15 and the poer-supply pattern formed on the printed-circuit board 6.

In the case of pulling out the battery plug 1 from the cigar lighter socket 111, the operating knob 24, which is exposed on the grip 22, is naturally slid backward by the user's finger along the operating aperture 23 against the spring action of the return spring 29.

Figure 3:
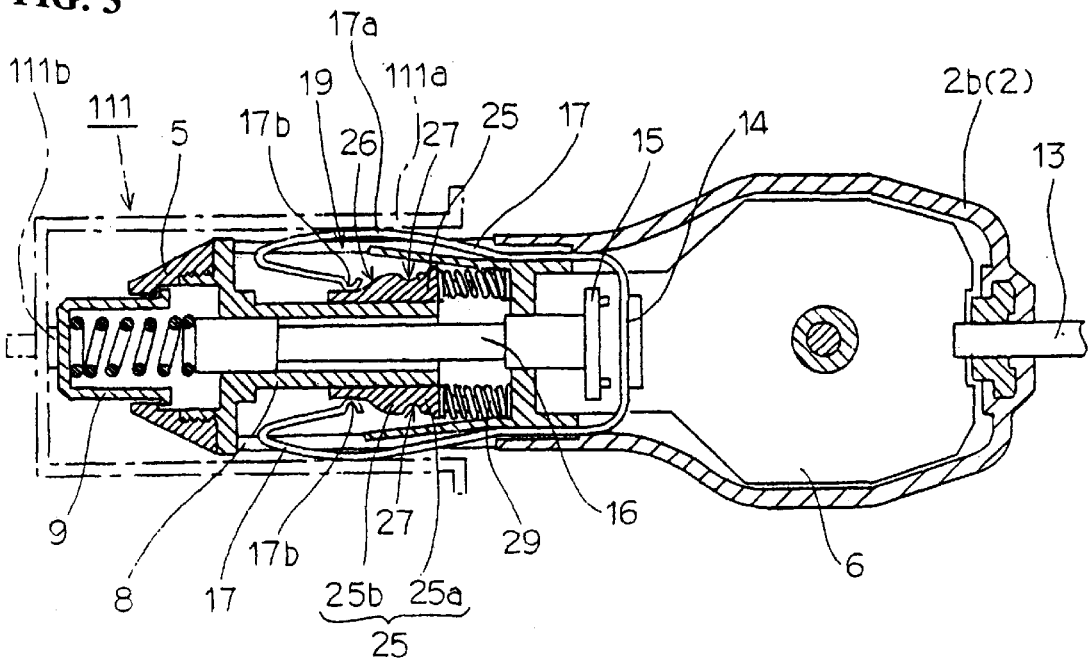
FIG. 3 is a horizontal sectional view depicting the state of the battery plug being pulled out of the cigar lighter socket.
Figure 4:
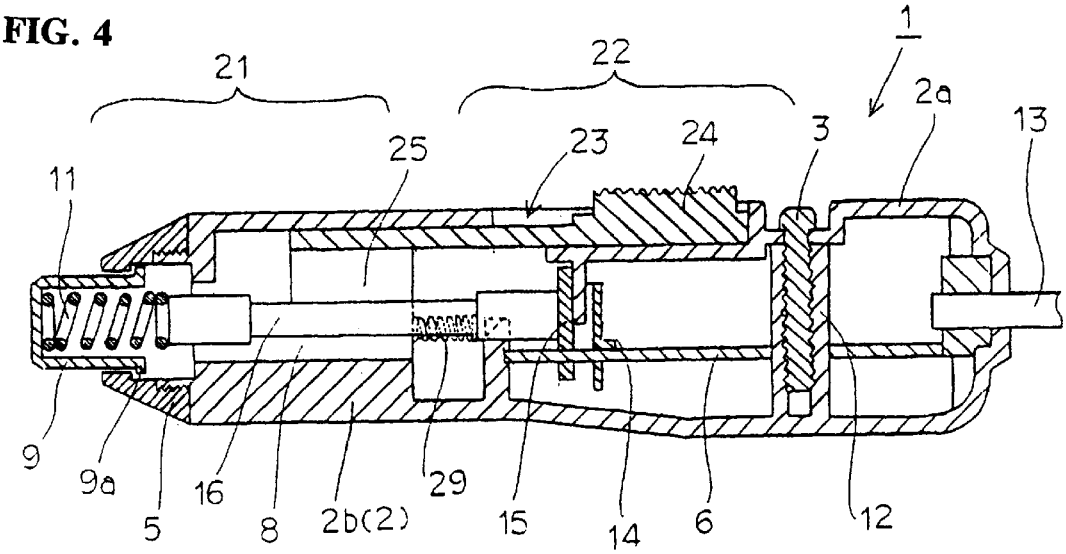
FIG. 4 is its longitudinal sectional view.

As depicted in FIGS. 3 and 4, when the operating knob 24 is moved back, the slider 25 is also slid rearward. With the backward movement of the slider 25, the return end portions 17*b* of the leaf-spring contact pieces 17 slide down the slopes of the slider 25 and go further into the plug housing 2. The contact portions 17*a* of the leaf-spring contact pieces 17, with the return end portions 17*b* thus retracted into the plug housing 2, also retract from their outermost to inner positions shown in FIG. 1, reducing the contact pressure to the cylindrical grounding terminal 111*a* of the cigar lighter socket 111 accordingly.

Hence, in this case, the battery plug 1 can easily be removed from the cigar lighter socket 111 with a very small amount of force.

While the car battery plug 1 is fitted in and connected to the cigar lighter socket 111, the return end portions 17*b* of the leafspring contact pieces 17 are in engagement with the positioning grooves 27, and consequently, the slider 25 cannot readily be slid unless the operating knob 24 is moved backward. With this structure, there is no possibility that the slider 25 slides due to unexpected external force and forces the return end portions 17*b* of the leaf-spring contact pieces 17 away from the positioning grooves 27 onto the slopes 26, reducing the plug retentive force and hence resulting in the battery plug 1 coming off the cigar lighter socket 111.

When releasing the operating knob 24 after pulling out the car battery plug 1 from the cigar lighter socket 111, the slider 25 returns to the foremost position on the guide frame 8 under the action of the return spring 29. As the result of this, the return end portions 17*b* of the leaf-spring contact pieces 17 abut again the support portions 25*a* of the slider 25 and the contact portions 17*a* greatly protrude to their outermost positions through the openings 19 due to their own resiliency. Hence the battery plug 1 is restored to its initial state depicted in FIGS. 1 and 2.

Figure 8:
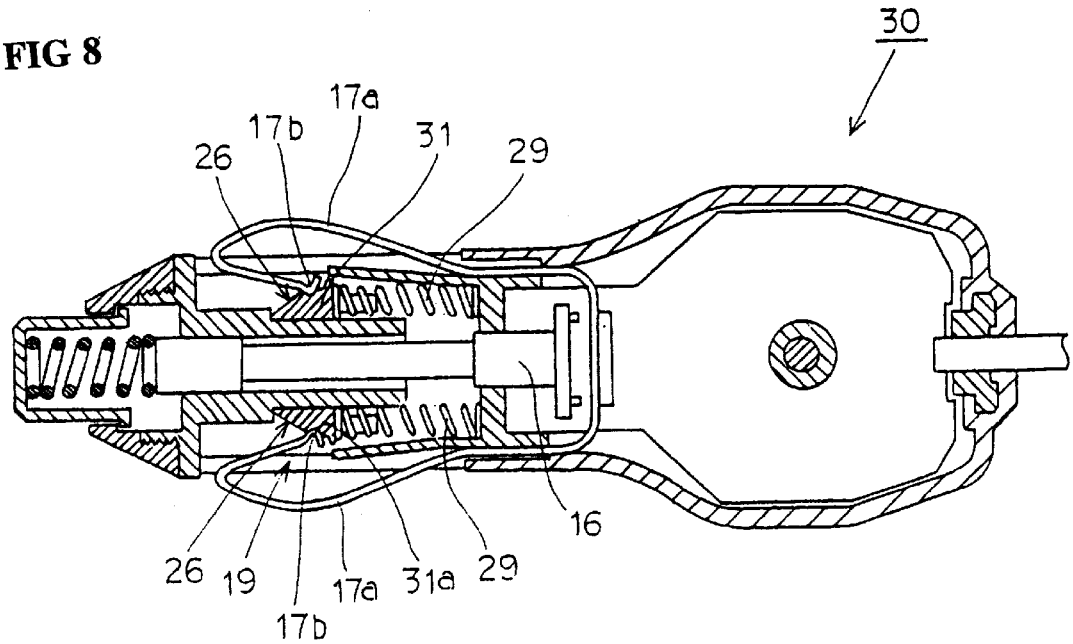
FIG. 8 is a horizontal sectional view showing an automotive battery plug according to a second embodiment of the present invention in its normal state prior to insertion into a cigar lighter socket.
Figure 9:
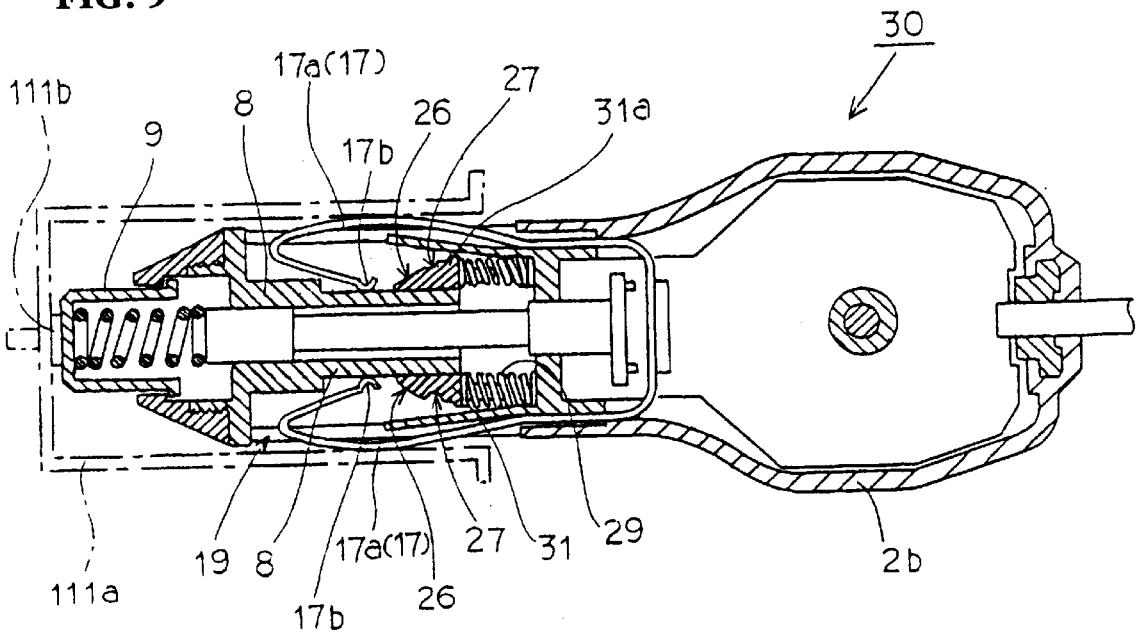
FIG. 9 is a horizontal sectional view showing the state of the battery plug of FIG. 8 being pulled out of the cigar lighter socket.
Figure 10:
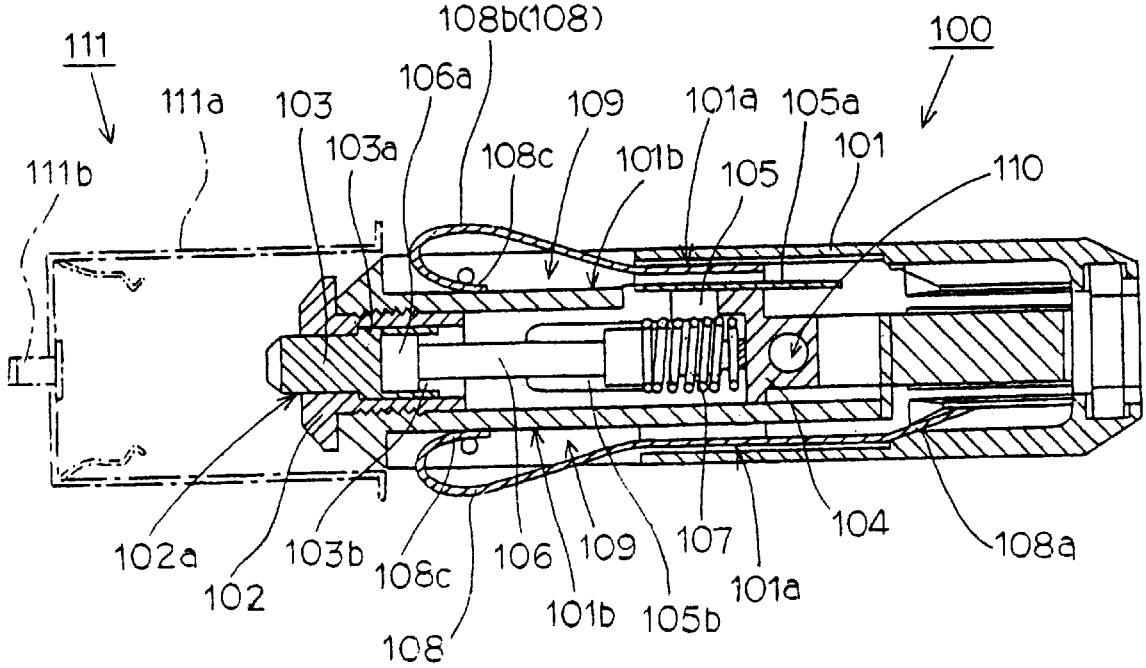
FIG. 10 is a horizontal sectional view showing the conventional car battery plug adjusted for insertion into a small-diameter cigar lighter socket.

FIGS. 8 and 9 illustrate an automotive battery plug 30 according to a second embodiment of the present invention, which is identical in construction with the plug 1 of the first embodiment except the side configuration of a slider 31. The parts corresponding to those in the first embodiment are identified by the same reference numerals and no description will be given of them.

In the first embodiment, when the operating knob 24 is brought to its rearmost position, the return end portion 17*b* of each leaf-spring contact piece 17 slides down the slope 26 and into abutment with the side surface of the slider 25 at a position inner than a support portion 31*a* of the slider 31. On the other hand, in the second embodiment the return end portion 17*b* slides down a slope 32 and gets out of contact with the side surface of the slider 31 and into abutment with the guide frame 8 as shown in FIG. 9.

According to the second embodiment, the position of the return end portion 17*b* can be changed vertically by making the return end portion 17*b* abut against the support portion 31*a* of the slider 31 or the guide frame 8. This provides increased difference between the plug retentive force and the force for removing the plug 1 from the socket 111 without increasing the thickness of the slider 31, that is, without upsizing the plug housing 2.

While in the second embodiment the return end portion 17*b* has been described to abut against the guide frame 8, it may also be made to abut against another part which lies at the forward position of sliding movement of the slider 31, such as the plug housing 2.

In the first and second embodiments the return spring 29 has been described to be used to urge the sliders 25 and 31 forward for automatic return to their initial positions, but the return spring 29 need not always be provided when the car battery plug 1 is adapted to automatically move the operating knob 24 forward at the time of fitting the battery 1 into the cigar lighter socket 111. The return spring 29 is not limited specifically to the coiled spring but may be a leaf spring or mold spring molded from synthetic resin as long as they urge the sliders 25 and 31 or the operating knob 24 forward at any times.

Although in the first and second embodiments the slider 25 or 31 and the operating knob 24 are formed as a unitary structure with each other, they may be formed separately and coupled together by means of screws. Alternatively, they may be operatively associated with each other through some other coupling members.

Furthermore, in the first and second embodiments slider 25 is guided lengthwise of the plug housing 2 by the U-shaped guide frame 8 molded integrally with the lower half shell 2*b*, but it may be guided directly by the plug housing 2 by forming the slider 25 so that its shape of projection in the front-to-back direction conforms to the inner wall surface of the cylindrical plug housing 2.

As described above, the automotive battery plug according to the present invention is suitable for use as a plug which is fitted in an automotive cigar lighter socket to feed power to vehicle-mounted portable equipment.

It will be apparent that many modifications and variations may be effected without departing from the scope of the novel concepts of the present invention.

What is claimed is:

1. An automotive battery plug comprising:

a cylindrical plug housing (2) for insertion into a cigar lighter socket (111);

a pair of leaf-spring contact pieces (17) each having its base portion fixed in said cylindrical plug housing (2) and its free end portion bent into a U-letter shape so that an outside contact portion (17*a*) extending from said base portion protrudes from the periphery of said plug housing (2) through an opening (19) thereof and an inside return end portion (17*b*) lies in said plug housing (2);

a slider (25, 31) disposed in said plug housing (2) in a manner to be slidable lengthwise thereof, either side surface of said slider resiliently contacting said return end portion (17*b*) of said leaf-spring contact piece (17);

support portion (25*a*, 31*a*) formed in either side surface of said slider (25, 31) for resilient contact with said return end portion (17*b*), said return end portion (17*b*) sliding into abutment with said support portion (25*a*, 31*a*) when said slider (25, 31) slides forward;

an inclined portion (25*b*) formed in either side surface of said slider (25, 31) and contiguous to said support portion (25*a*, 31*a*) along the front edge thereof so that when said slider (25) slides backward, said return end portion (17*b*) slides down a slope (26, 32) into said plug housing (2); and an operating knob (24) exposed on a grip (22) of said plug housing (2) through an operating aperture made therein and operatively associated with said slider (25, 31);

wherein when said plug is pulled out of a cigar lighter socket (111), said return end portion (17*b*) of said each leaf-spring contact piece (17) is retracted into said plug housing (2) by said operating knob (24) slid backward.

2. The automotive battery plug of claim 1, wherein a return spring (29) is disposed in said plug housing (2) to urge said slider (25, 31) toward the forward portion of said plug housing (2) so that said return end portion (17*b*) of said each leaf-spring contact piece (17) in its normal state abuts against said support portion (25*a*, 31*a*).

3. The automotive battery plug of claim 1 or 2, wherein said support portion (25*a*, 31*a*) has cut therein a positioning groove (27) for engagement with said return end portion (17*b*) of said each leaf-spring contact piece (17).

* * * * *